US005540042A

United States Patent [19]

Schuller et al.

[11] Patent Number: 5,540,042

[45] Date of Patent: Jul. 30, 1996

[54] OPEN-END SPINNING DEVICE

[75] Inventors: Edmund Schuller; Manfred Knabel, both of Ingolstadt; Erich Bock, Wettstetten, all of Germany

[73] Assignee: Rieter Ingolstadt Spinnereimaschinenbau AG, Ingolstadt, Germany

[21] Appl. No.: 308,100

[22] Filed: Sep. 16, 1994

[30] Foreign Application Priority Data

Oct. 15, 1993 [DE] Germany ..... 43 35 236.7

[51] Int. Cl.[6] ..... D01H 4/44

[52] U.S. Cl. ..... 57/88; 57/92; 192/135; 192/144

[58] Field of Search ..... 192/144, 10, 11, 192/135; 57/88, 92

[56] References Cited

U.S. PATENT DOCUMENTS 4,059,947 11/1977 Stahlecker ..... 57/92 X
4,265,083 5/1981 Braun et al. .
4,574,577 3/1986 Derichs et al. ..... 57/88 X
4,753,067 6/1988 Landwehrkamp et al. ..... 57/92 X
4,760,688 8/1988 Beitzinger .
4,899,528 2/1990 Fahmuller et al. ..... 57/92

*Primary Examiner*—Rodney H. Bonck
*Attorney, Agent, or Firm*—Dority & Manning

[57] ABSTRACT

The spinning rotor of an open-end spinning device is supported by means of a rotor shaft in the nip of at least one pair of supporting disks and can be driven by means of a tangential belt. A change-over device with a pressure roller is provided to press the tangential belt against the rotor shaft and a rotor brake which can be brought into action alternatively is provided. The change-over device is connected to a control lever which can be controlled as a function of the position of an actuator connected to a spinning station cover. The control lever is provided with an actuating arm. By opening the spinning station cover completely, a sufficient clearance can be produced between the actuator and the control lever so that the rotor brake can be deactivated through action exerted on the actuating arm of the control lever by means of the change-over lever on the one hand without allowing on the other hand the pressure roller to be yet actuated. The control lever can be made in several segments, with a first lever segment being connected to the change-over device and interacting with the actuator of the spinning station cover, while a second lever segment is provided with the actuating arm and interacts with the first lever segment.

7 Claims, 3 Drawing Sheets

OPEN-END SPINNING DEVICE

BACKGROUND OF THE INVENTION

The instant invention relates to an open-end spinning device with a spinning station cover that can be opened to expose the spinning device, with a spinning rotor which is mounted by means of a rotor shaft in the nip of at least one pair of support disks and is driven by means of a tangential belt, with a change-over device equipped with a pressure roller to press the tangential belt against the rotor shaft and with a rotor brake which can be actuated alternatively, whereby the change-over device is connected to a control lever which is pushed in the direction of a setting element connected to the spinning station cover as a function of the position of the actuator, this pushing action being carried out by an element which deactivates the pressure roller and actuates the rotor brakes when the change-over device is released.

In a known device of this type (DE 28 11 960 A1, DE 34 47 428 A1) a spinning station cover is provided in which an actuating lever is installed which can be moved together with the spinning station cover or in relation to the latter. This actuating lever is equipped with an actuator in the form of a cam which interacts with a control lever. When the spinning rotor must be replaced, the spinning station cover is fully opened together with the actuating lever so that the spinning rotor may become accessible. The rotor brake which, in this position, presses on the rotor shaft, goes however into action to prevent the spinning rotor which rotates at a high speed from hurting the operator. The pressing of the rotor brake against the rotor shaft however makes the replacement of the spinning rotor much more difficult and in most cases makes it impossible. To be nevertheless able to replace the spinning rotor, provisions were previously made to lift the rotor brake from the rotor shaft in an intermediate position of the spinning station cover. For safety reasons (different tolerances from one spinning station to the other) this intermediate position must however be wider than the position in which the spinning station cover is opened completely. This means that in order to replace the spinning rotor, the spinning station cover together with the actuating lever must be moved slightly in the closing direction, so that the open-end spinning device and the spinning rotor becomes in turn less accessible. For this reason rotor replacement can only be carried out under difficult conditions in the known device because of poor accessibility of the spinning rotor.

OBJECTS AND SUMMARY OF THE INVENTION

It is a principal object of the instant invention to create a possibility for an easy replacement of the rotor and good accessibility of same while maintaining the safety conditions, demanding braking of the spinning rotor, that is required when the spinning station cover is open. Additional objects and advantages will be set forth in part in the following description, or may be obvious from the description, or may be learned through practice of the invention.

The objects are attained according to the invention in that the control lever is provided with an actuating arm and that complete opening of the spinning station cover can produce such clearance between the actuator and control lever that by acting upon the actuating arm of the control lever, the rotor brake can be deactivated by means of the change-over lever, without actuating the pressure roller. By producing a clearance between the actuator of the spinning station cover and the control lever, a possibility is created to move this control lever independently of the position of the actuator and thereby of the spinning station cover. This means that it is now possible, thanks to this clearance, to move the control lever in relation to the spinning station cover in such manner that the rotor brake is again lifted from the rotor shaft so that the rotor shaft and thereby the spinning rotor are released. This movement of the control lever is now carried out in such manner that, although the rotor brake is already out of action on the one hand, on the other hand the pressure roller does not yet bring the drive belt (or one of the drive belts) back into driving connection with the rotor shaft, since a rotating spinning rotor would constitute a danger to the operator who must carry out the rotor replacement. The actuating arm is necessary for an intervention from the outside in order to actuate the control lever, and it is immaterial whether this intervention is manual or automatic—e.g. from a travelling service carriage.

To ensure service of the control lever without danger to an operator or service carriage, it is important that the spinning rotor is certain not to be driven in the position of the control lever which is provided for rotor replacement. For this reason, it is an advantageous further development of the invention to provide for a fixing device to be associated with the control lever to fix the position in which the rotor brake and the pressure roller are out of action.

Different configurations are possible for the fixing device, its design depending to a great extent of such factors as the configuration of the connection between spinning station covers or between control lever and change-over device. In a universally applicable embodiment of the device according to the invention, the fixing device is made in the form of a catching device which releases the control lever when a predetermined force is exceeded.

Not only the connection between control lever and change-over device, but also the control lever itself may be designed in various manners. In a particularly advantageous embodiment of the device according to the instant invention, the control lever is made in several parts, with a first lever segment being connected to the change-over device and interacting with the actuator of the spinning station cover, while a second lever segment is equipped with the actuating arm which extends within servicing range and interacts with the first lever segment. In such an embodiment of the control lever as a multi-segment element, the fixing device is preferably associated with the second lever segment and is made in the form of a rigid stop.

The actuator of the spinning station cover may also be designed in different manners. Thus it is not necessary for this actuator to be an integral part of the spinning station cover. In a preferred embodiment of the invention, the actuator of the spinning station cover is made in the form of an actuating lever which can be moved together with the spinning station cover or in relation to the cover and which interacts with the control lever.

The device according to the invention uses simple means to ensure good access to the spinning rotor for possible replacement on the one hand, and on the other hand ensures that the shaft is disengaged during this replacement. The removal and installation of a spinning rotor can thus be carried out easily. Since only a few parts are to be replaced in order to rebuild a spinning station in this manner, an existing spinning station can thus also easily be converted.

The invention is explained in detail below through examples of embodiments.

DETAILED DESCRIPTION OF THE PREFERRED EMBODIMENTS

Figure 1:
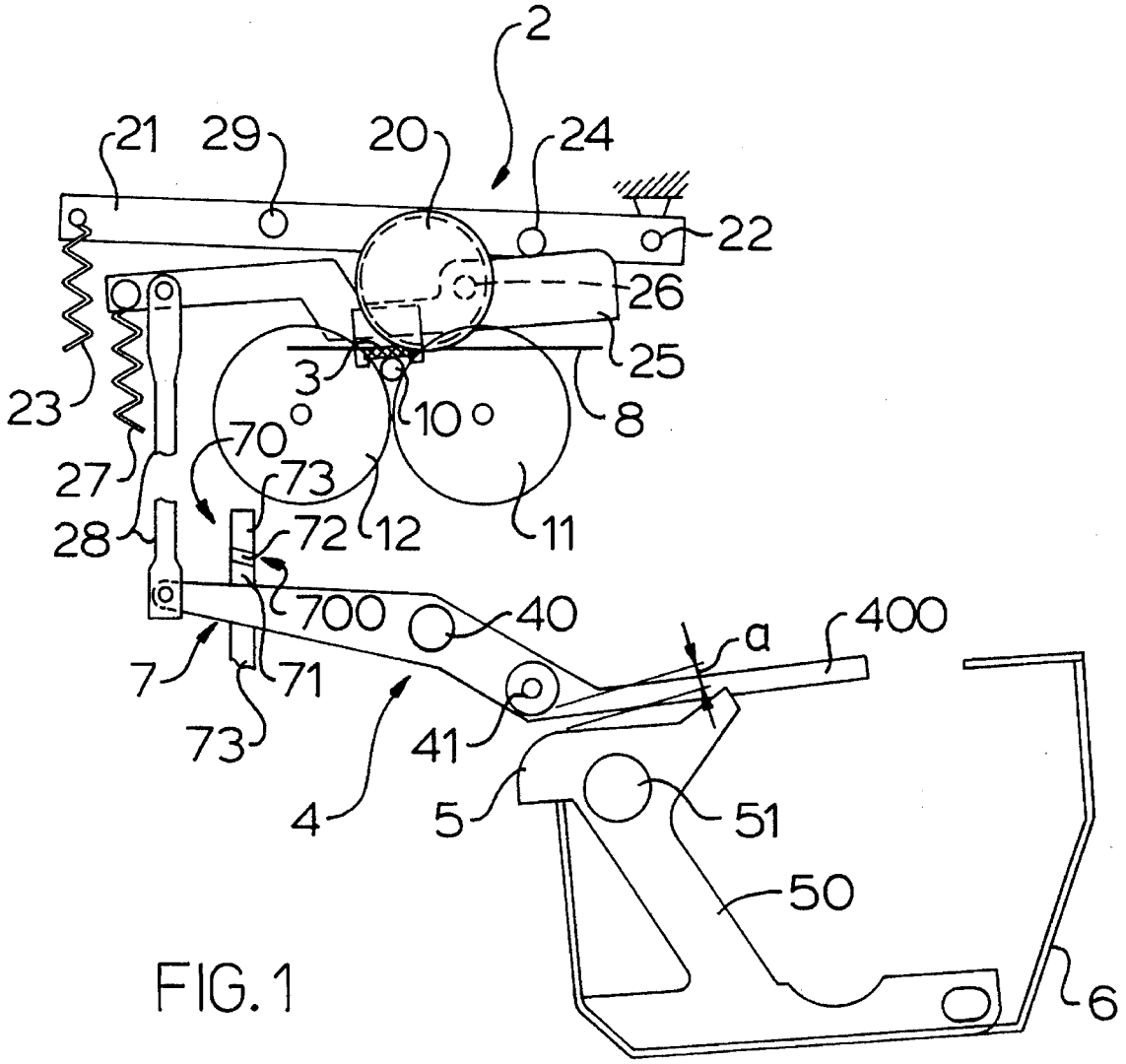
FIG. 1 shows the parts of an open-end spinning station which are necessary to understand the invention, whereby the lower portion of the drawing shows a schematic side view and the upper portion shows a forward view rotated by 90° thereto.

Reference will now be made in detail to the presently preferred embodiments of the invention, one or more examples of which are illustrated in the figures. Each example is provided by way of explanation of the invention, and not as a limitation of the invention. The number of components in the drawings is consistent throughout the application, with the same components having the same number in each of the drawings.

A first embodiment of the invention is explained below through FIGS. 1 to 3. These drawings shown an open-end spinning device with only those parts shown which are needed to understand the invention. Normally a plurality of such spinning devices are installed next to each other in an open-end spinning machine.

Figure 4:
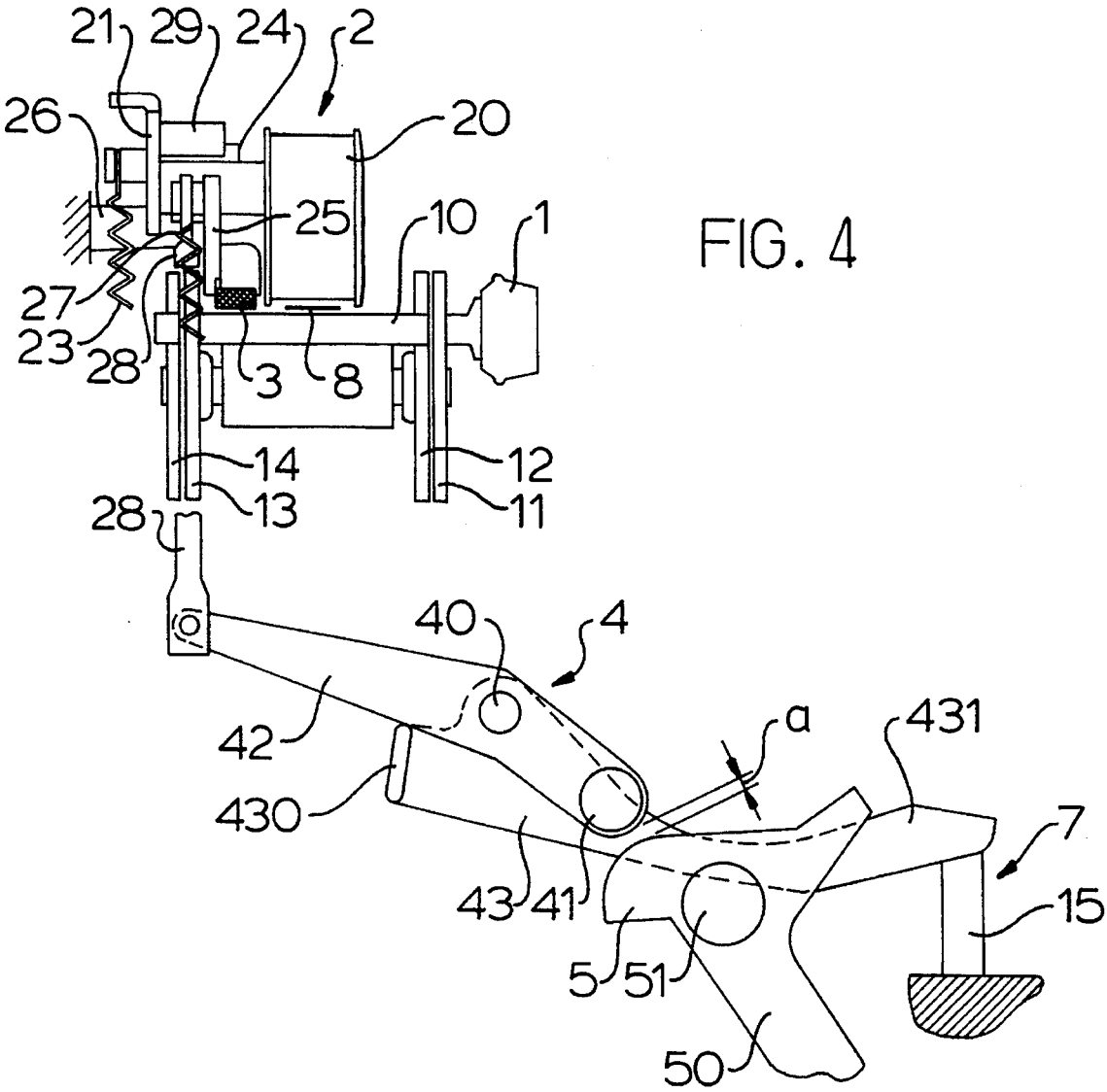
FIG. 4 shows a variant of the invention in schematic side view.

The spinning device is equipped with a spinning rotor 1 (FIG. 4) which is mounted by means of a rotor shaft 10 in the nip of two pairs of supporting disks 11 and 12 and 13 and 14 (also see FIG. 4). To simplify the drawing, the elements needed to open a fiber sliver and to convey fibers to the spinning rotor 1 and those needed to withdraw a yarn from the spinning rotor 1 are not shown in FIG. 1. These elements are of the usual design.

The spinning rotor 1 is driven by means of a tangential belt 8 which extends in the usual manner along the open-end spinning machine and is thus used to drive a plurality of adjoining spinning rotors 1.

The tangential belt 8 is guided by means of supporting rollers between the individual spinning stations in a manner not shown here, these supporting rollers causing the tangential belt 8 to release the rotor shaft 10 when it is not forced into contact against the rotor shaft 10 by means of a pressure roller 20. This pressure roller 20 is part of a change-over device 2 and is borne by a one-armed change-over lever 21 pivotably mounted on a stationary swivel axle 22 and which is pressed in the direction of the tangential belt 8 by a tension spring 23 hooked into the free end of the change-over lever 21 and anchored by its other end to a stationary point which is not shown. The change-over lever 21 is equipped with a bolt 24 which is in contact with the side edge of a brake lever 25. This brake lever is mounted on a fixed swivel axle 26 and on its arm away from the arm which interacts with bolt 24, it supports a rotor brake 3. The brake lever 25 is influenced by a tension spring 27 in such a manner that the rotor brake 3 is pressed in the direction of the rotor shaft 10. The other end of the tension spring 27 is hooked in the usual manner into a stationary spring hook which is not shown.

The change-over lever 21 is equipped with an additional bolt 29 able to interact with the brake lever 25 on the side away from the swivel axle 22 in relation to the pressure roller 20.

A connection rod 28 is connected to the arm of the brake lever 25 which is subjected to the force of the tension spring 27 and its other end is connected to a two-arm control lever 4. This control lever 4 is mounted on a stationary swivel axle 40 and supports on its other arm a control roller 41 which interacts with an actuator 5. The actuator 5 is part of an actuating lever 50 which is mounted together with a spinning station cover 6 on a common swivel axle 51. The actuating lever 50 can be moved together with the spinning station cover 6 or in relation thereto, depending on the desired function. Further details can be found in the documents DE 28 11 960 A1 and DE 34 47 428 A1.

The actuator 5 is designed so that when the spinning station cover 6 together with actuating lever 50 are in a closed position in which the open-end spinning device is covered, the actuator 5 acts upon the control roller 41 in such manner that the connecting rod 28 is pushed up and thereby lifts the rotor brake 3 from the rotor shaft 10. The brake lever 25 thus comes to lie against bolt 29.

The lifting of the connection rod 28 causes the brake lever 25 to be swivelled around the swivel axle 26 so that the brake lever 25 frees the bolt 24. Under the influence of the tension spring 23 the change-over lever 21 is thus swivelled around its swivel axle 22 in the direction of the rotor shaft 10 until the pressure roller 20 presses the tangential belt 8 against the rotor shaft of the spinning rotor 1. At the same time the movement of the lever 21 in the direction of the rotor shaft 10 is limited by the bolt 29 which comes to lie against the brake lever 25.

Since the pressure roller 20 holds the tangential belt 8 in drive connection with the rotor shaft 10, the spinning rotor 1 is driven in this position.

Additional functions which can be achieved by means of the actuating lever 50 and the hinged spinning station cover 6 are not described here in further detail. The only interesting detail in connection with the object of the device described here is merely the fact that when the spinning station cover has been swivelled away completely from the control roller 41, a clearance a exists between the control roller 41 and the actuator 5. This clearance makes it possible for the control lever 4 to be moved independently of a movement of the spinning station cover 6 or of the actuating lever 50.

As shown in FIG. 1, the control lever is twisted further and further in a counterclockwise direction under the force of the tension spring 27 when the spinning station cover 6 is opened until the rotor brake 3 pressed against the rotor shaft 10 is finally released. As this movement of the brake lever 25 around its swivel axle 26 is carried out, its arm away from the tension spring 27 acts upon bolt 24, whereby the brake lever 25, through its swivelling movement and its influence upon the bolt 24, causes the change-over lever 21 to be moved around its swivel axle 22 in a clockwise direction. The pressure roller 20 is then lifted from the tangential belt 8. The latter is lifted from the rotor shaft 10 because of the above-mentioned but not shown supporting rollers and because of the tension in the tangential belt 8. The spinning rotor 1 is thus braked (see FIG. 1).

When the spinning station cover 6 is in its swivelled, i.e. in its open position, the operator is able to work on the spinning device without danger since the spinning rotor 1 is braked. Other elements not shown here, such as the opener roller, are shielded from the operator, e.g. by being placed in a closed housing.

When the spinning station cover 6 is in this open position, the spinning rotor 1 is easily accessible. Nevertheless the spinning rotor 1 can be removed only with difficulty since the rotor shaft 10 is under the load of the rotor brake which produces much friction between itself and the rotor shaft 10. This pressure force is very great because rapid stoppage of the spinning rotor 1 must be achieved during the opening of the spinning station cover 6.

If the removal of the spinning rotor 1 causes difficulties, those involved in installing a spinning rotor 1 are considerably greater. This is because the rotor brake 3 must be lifted against the force produced by the tension spring 27. Even if the end of the rotor shaft 10 away from the spinning rotor 1 is made in the form of a cone, it is practically impossible to install the spinning rotor 1 in its working position without lifting the rotor brake 3. In practice it is therefore necessary to lift the spinning station cover 6 until the actuator 5, by acting on the control roller 41, swivels the control lever 4 to such an extent that the brake lever 25 lifts the rotor brake 3 sufficiently far so that the rotor shaft 10 can be passed through under the rotor brake 3 and into its work position.

Since unintentional driving of the spinning rotor 1 must be absolutely prevented, it is necessary to lift the spinning station cover 6 relatively far to achieve a release of the rotor shaft 10 from the rotor brake 3, and in this case the spinning rotor 1 can only be reached with difficulty in the spinning devices known until now. Removal of the spinning rotor 1 and installation of a new one is therefore extremely difficult because of poor accessibility.

This is where the invention comes into play. By providing for such a large clearance between the actuator 5 and the control roller 41 when the spinning station cover 6 is in open position, the control lever 4 can be moved in relation to the actuator 5. As shown in FIGS. 1 and 2, the end of the control lever 4 away from the connection rod is made in the form of an actuating arm 400. The pressure applied to this actuating arm 400 causes the connection rod 28 to be lifted until the rotor brake 3 releases the rotor shaft 10 (In FIG. 2, compare the control lever indicated by hatch marks with the release position indicated by a full line). This lifting action is calculated here so that the pressure roller 20 can be swivelled in the direction of rotor shaft 10 only to such an extent, in spite of partial release of the bolt 24, that the pressure roller 20 does not yet press the tangential belt 8 into drive contact against the rotor shaft 10.

The rotor shaft 10 is thus completely free and is not subjected to the influence of the rotor brake 3, nor is the tangential belt 8 in drive connection with the rotor shaft 10. This ensures on the one hand that the spinning rotor 1 is not driven. On the other hand however, this causes the rotor shaft 10 to be guided in the nip between the supporting disks 11 to 14 without any load, so that it can easily be pulled out of this nip on the servicing side. It should be noted that the spinning station cover 6 is completely open during this removal of the spinning rotor 1, so that access to the spinning rotor 1 is not hindered in the least. Installation or removal of the spinning rotor 1 can therefore be carried out easily and rapidly, with the spinning rotor 1 being not only well visible but very accessible and, as stated before, free of load and not in drive.

As mentioned earlier, the spinning rotor 1 must be free of load on the one hand when the control lever 4 is in shaft-release position, and on the other hand it may not yet be driven. This can be achieved by means of suitably wide tolerances in the movement of the control lever 4. A design in which the control lever 4 is associated directly or indirectly with a fixing device 7 which fixes the position in which the rotor brake 3 as well as the pressure roller 20 and therefore also the tangential belt 8 are out of action is better and most of all safer.

Figure 2:
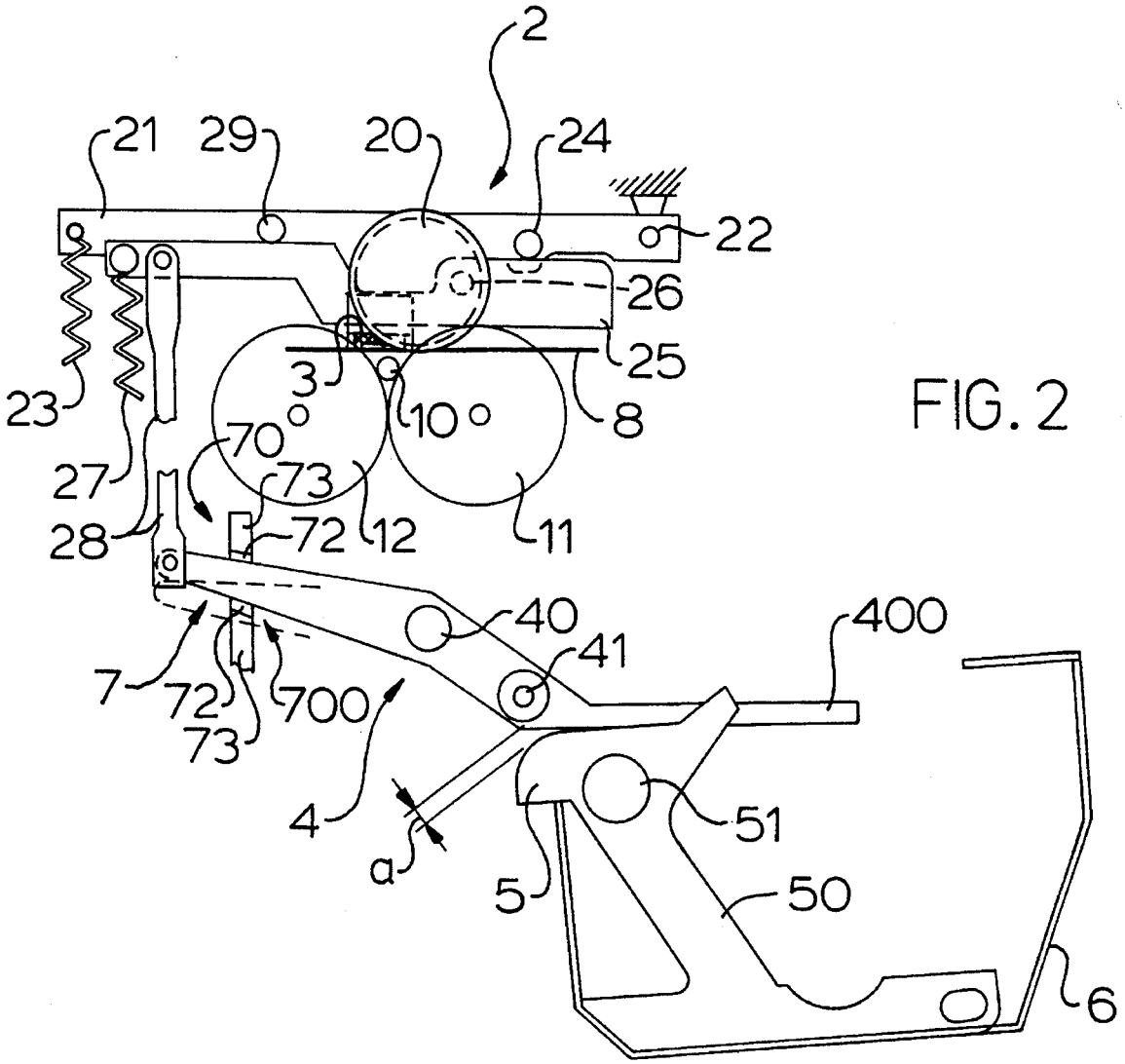
FIG. 2 shows the device shown in FIG. 1 in the position with disengaged rotor shaft.
Figure 3:
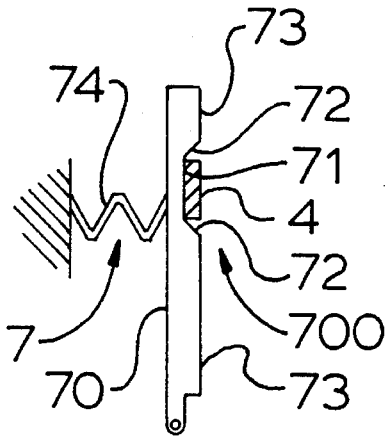
FIG. 3 shows the catching device shown in FIGS. 1 and 2, in a frontal view.

Since it must be possible to move the control lever 4 in both directions beyond the release points if the control lever 4 is made in one piece, the fixing device 7 in the embodiments shown in FIGS. 1 to 3 is made in the form of a catch 700. Such a catch 700 may of course be designed in different manners. The control lever 4 can be moved in a slot, for example, and be provided with a spring-loaded ball which catches in a recess (not shown) when the control lever 4 is in relief position.

In the embodiments shown in FIGS. 1 to 3 the catching device 700 is designed so that a lever 70 capable of moving at a right angle to the movement of control lever 4, e.g. a pivotable lever is provided which has a recess 71 corresponding to the relief position and which slides over ramps 72 in a general sliding surface 73 (longitudinal surface of control lever 4). The lever 70 is held against the control lever 4 by means of a compression spring 74.

As the control lever 4 is swivelled, it goes into the catch position determined by the catching device 700. If the force exerted upon the control lever 4 exceeds a predetermined value, e.g. when the spinning station cover 6 is opened, the catching device 700 cannot hold back the control lever 4. However, if the control lever 4 is actuated with a force below the predetermined limit as the spinning station cover 6 is open, said control lever 4 is stopped in the relief position and the rotor can easily be installed or removed.

In the embodiment described above a one-piece control lever 4 is provided to control the change-over device 2 (rotor brake 3 as well as pressure roller 20). This is especially advantageous from the point of view of production and also with respect to the space required for this control lever 4. It may nevertheless be advantageous to use a divided control lever 4, as shown in FIG. 4, instead of the one-piece control lever 4. In that case a first lever segment 42 is used to transmit the movement of the spinning station cover 6 or of the actuating lever 50 mounted in the spinning station cover 6 to the rotor brake 3 and the pressure roller 20. A second lever segment 43 is provided which is mounted together with lever segment 42 on the swivel axle 40 and which reaches with its end 430 under the arm of lever segment 42 towards the connection rod 28 in order to interact with the lever segment 42. The other arm (actuating arm 437) is used for actuation by the operator or by a servicing device.

The lever segment 42 is able to carry out its control movement independently of the lever segment 43 which is always held by its end 430 in contact against lever segment 42 because of the longer level arm of arm 431 and follows the movement of lever segment 42.

A fixed, rigid stop 15 which limits the movement of the lever segment 43 is assigned to the lever segment 43 to serve as a fixing device 7. A precisely defined position which is needed to relieve the rotor shaft 10 from the rotor brake 3 can thus be determined for the movement of the lever segment 43 and therefore also of the lever segment 42. Even with narrow tolerances, this position can be maintained very easily and with great certainty.

As stated earlier, the control lever 4 or the lever segment 43 can be actuated either manually by the operator or automatically by an automatic device. Provisions may be made for instance, for the spinning rotor 1 to be automatically removed, examined and re-installed by an automatic servicing device after a certain running time, or, if the spinning rotor 1 is found to be defective, to be replaced by a new spinning rotor 1. It is furthermore possible to provide for all the spinning rotors 1 of a spinning machine or a spinning machine side to be replaced by an automatic device by spinning rotors 1 of a different size, e.g. when there is a change of batch.

Additional variations of the described device are possible by replacing characteristic features by their equivalents or by other combinations thereof. Thus for instance, the special design of the rotor bearing by one or two pairs of supporting disks and the possible installation of additional supports has no bearing on the invention.

The invention has been explained above for an example of an embodiment in which only one single tangential belt 8 is provided to drive the spinning rotor 1. It is however absolutely possible to provide a second tangential belt (not shown) which can be brought to bear during piecing, whereby the change-over device 2 would be provided in addition to the rotor brake 3 not only with one pressure roller 20, but with two pressure rollers for the two tangential belts which can be brought to bear selectively.

The described actuating lever 50 which is mounted in the spinning station cover 6 and is capable of movement relative to the latter is not absolutely necessary if it is not deemed necessary to control, by means of an actuating lever 50, certain not absolutely necessary processes even when the spinning station cover 6 is closed, e.g. rotor cleaning. If the spinning station cover 6 is opened for rotor cleaning for example, and a cleaning device (not shown) is introduced through the exposed, open rotor side into the spinning rotor 1, no actuating lever 50 is required, so that the actuator 5 can be part of the spinning station cover 6 or can be displaced by same. The actuator 5 can also be of different design, e.g. in form of a lever.

In the described embodiments of the device the control lever 4 is pushed, with intercalation of other elements, by tension springs 23 and 27 in the direction of the actuator 5 until this movement is restricted by the application of the rotor brake 3 on the rotor shaft 10. Other means to influence the brake lever 25 and/or the control lever 4, e.g. weights, pneumatic or hydraulic pistons, etc., are however also possible alternatives.

It will be apparent to those skilled in the art that various modifications and variations can be made in the present invention without departing from the scope or spirit of the invention. For example, features described or illustrated as part of one embodiment can be used on another embodiment to yield a still further embodiment. It is intended that the present invention cover such modifications and variations as come within the scope of the appended claims and their equivalents.

We claim:

1. An open-end spinning device, comprising:

a spinning rotor mounted on a rotor shaft and supported in the nip of at least one pair of support disks, said rotor driven by a tangential belt;

a pivotable spinning station cover configured to cover said spinning rotor in a closed position and to expose said spinning rotor in an open position, said spinning station cover further comprising an actuator;

an actuable change-over device equipped with a pressure roller configured to press said tangential belt against said rotor shaft in an engaged position of said change-over device, said change-over device further comprising a rotor brake configured to brake said spinning rotor in a released position of said change-over device;

a control lever connected to said change-over device to switch said change-over device between said engaged and released positions, said control lever being actuated by said spinning station cover actuator so that in said open position of said cover said change-over device is in said released position and in said closed position of said cover said change-over device is in said engaged position, said control lever and said actuator disposed relative each other so that in said open position of said spinning station cover a clearance space exists therebetween; and an actuating arm configured with said control lever, said actuating arm disposed relative said control lever so that in said open position of said spinning station cover a force exerted upon said actuating arm shifts said change-over device to an intermediate position wherein said rotor brake is deactivated and said pressure roller is disengaged from said tangential belt.

2. The open-end spinning device as in claim 1, wherein said actuating arm is formed integral with said control lever.

3. The open-end spinning device as in claim 1, further comprising a fixing device configured to fix the position of said control lever in said intermediate position.

4. The open-end spinning device as in claim 3, wherein said fixing device comprises a catching device configured to catch said control lever upon actuation of said actuating arm.

5. The open-end spinning device as in claim 1, wherein said control lever comprises a plurality of segments, a first said segment being connected to said change-over device and being engaged by said actuator, and a second said segment configured with said actuating arm and engaged with said first said segment.

6. The open-end spinning device as in claim 5, further comprising a fixing device configured to fix the position of said control lever in said intermediate position, said fixing device disposed to engage said second segment.

7. The open-end spinning device as in claim 1, wherein said spinning station cover further comprises an actuating lever which is controllable such as to be movable with said spinning station cover, said actuator configured with said actuating lever.

* * * * *